US006497133B1

(12) United States Patent
Rose

(10) Patent No.: US 6,497,133 B1
(45) Date of Patent: Dec. 24, 2002

(54) CABLE CUTTER AND BENDER

(76) Inventor: Larry J. Rose, 301 E. Co. Rd. 132, Midland, TX (US) 79706

( * ) Notice: Subject to any disclaimer, the term of this patent is extended or adjusted under 35 U.S.C. 154(b) by 9 days.

(21) Appl. No.: 09/921,190

(22) Filed: Aug. 1, 2001

(51) Int. Cl.[7] ..... B21D 7/024
(52) U.S. Cl. ..... 72/388; 72/390.5; 72/464
(58) Field of Search ..... 72/384, 386, 387, 72/388, 390.5, 458, 464, 216; 7/158

(56) References Cited

U.S. PATENT DOCUMENTS

| | | | | |
|---|---|---|---|---|
| 1,379,016 A | | 5/1921 | Henderson | |
| 2,605,665 A | | 8/1952 | Grenat | |
| 3,918,286 A | | 11/1975 | Whitehead | |
| 4,206,629 A | | 6/1980 | Grimaldo | |
| 4,304,117 A | * | 12/1981 | Rawson | 72/388 |
| 5,490,409 A | | 2/1996 | Weber | |
| 5,680,789 A | | 10/1997 | Brooke | |
| 6,418,773 B1 | * | 7/2002 | Tolman | 72/388 |

* cited by examiner

*Primary Examiner*—Lowell A. Larson
(74) *Attorney, Agent, or Firm*—Milburn & Peterson, P.C.; Robert C. Peterson

(57) ABSTRACT

A combination cable cutter and bender includes a pair of arms each terminating at one end in a cutting blade pivotally mounted to form a cutting jaw, a first guide mounted on the pivot, a second guide spaced from the pivot on one of the pair of arms, an offset plate attached to the other arm supporting a third guide more distal from the pivot than the second guide, whereupon spreading the arms apart, a straight section of cable for bending is positionable between the first and second guide on one side and the third guide on the other side and closing the arms together bends the cable to the desired degree.

11 Claims, 3 Drawing Sheets

CABLE CUTTER AND BENDER

BACKGROUND OF THE INVENTION

1. Field

This invention relates to a hand held tool for cutting and bending cable, heavy wire, rods and tubes. One arm of the cable tool has a roller mounted near the pivot pin of the tool and the other arm has a bracket mounting a second roller. A roller is also mounted at the pivot of the jaws. The tool may be opened to provide a straight line through the rollers for inserting a cable to be bent. The bracket and rollers can be removed, if necessary, for purposes of using the cutter function of the tool, where the bender components would hinder the maneuverability of the tool.

2. State of the Art

The prior art describes various types of tools for bending cable or the like, such as disclosed in U.S. Pat. No. 5,680,789 to Brook, which has two (2) spaced apart guides and uses a ratchet wrench function to bend cable.

Another cable bender disclosed in U.S. Pat. No. 5,490,509 to Weber, describes a cam action surgical rod bender, but doesn't describe a rod bender and cutter combination. The bender is primarily designed for use during surgical procedures.

Other prior art showing various bending tools are set forth on the Information Disclosure Statement by Applicant.

SUMMARY OF THE INVENTION

The present invention provides an improved portable tool for use in the field for cutting and bending cable and the like to fit in the various electrical boxes which require various bends in generally stiff cable, necessitating substantial effort to shape to conform to the confines of the electrical boxes, while at the same time accommodating cutting the cable to its appropriate length.

Therefore, it is an object of the invention to provide a cable cutter and bender, which can be maneuvered by one individual for cutting and shaping the cable to conform to space allotted for installing the cable.

Another object of the invention is to provide an inexpensive combination cable cutting and bending tool, which may be easily handled by an individual shaping cable to conform to the required configuration in an electrical junction box or similar application.

Another object of the invention is to provide a combination tool for cutting and bending cable to conform to the interior geometry of electrical junction boxes and panel boxes and maintain an easily traceable wiring pattern.

Still another object of the invention is to provide a combination tool for cutting and bending cables to conform to the interior geometry of an electrical junction box or panel box whereby the cutting function and the bending function are compatible in that a roller mounted at the cutting jaw pivot does not interfere with the independent functions of the tool.

A further object of the invention is to provide a cable cutter and bender tool in which the bender elements may be removed or replaced in the field if damaged with new parts, which are readily attachable to the tools thus avoiding the necessity of carrying extra tools to the job site and thereby decreasing any idle time of installers.

It is an additional object of the invention to provide a cable cutter and bender adapted to bend cable to various degrees up to a ninety degree (90°) bend in multiple locations to readily conform to one hundred eighty degree (180°) bends and bends in different planes.

DESCRIPTION OF THE PREFERRED EMBODIMENT(S)

Figure 1:
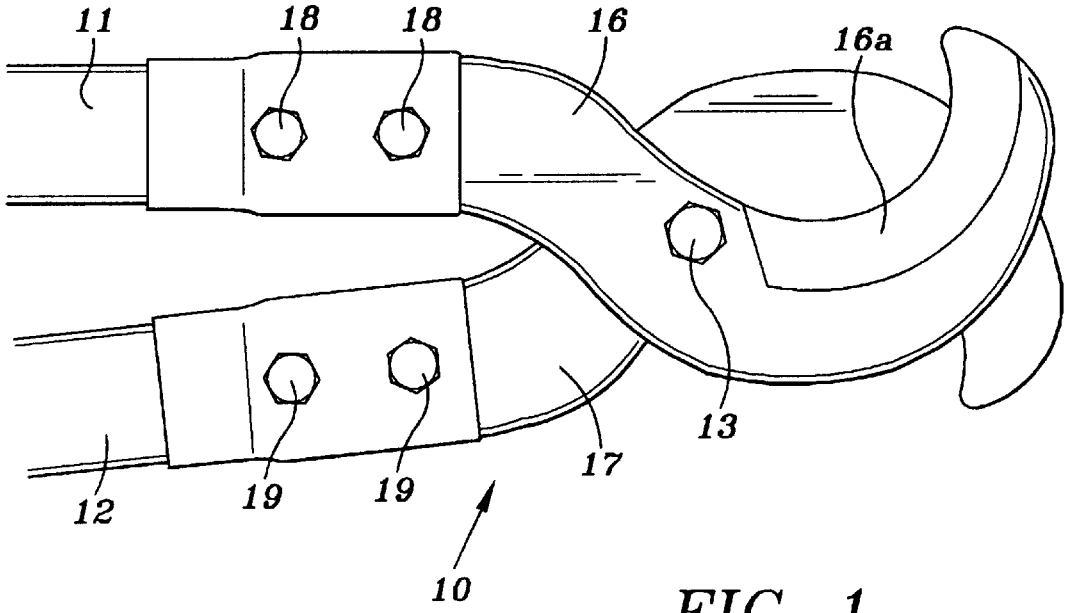
FIG. 1 shows a plane view of a cutting tool for cable and the like, which has removable and replaceable handles.
Figure 2:
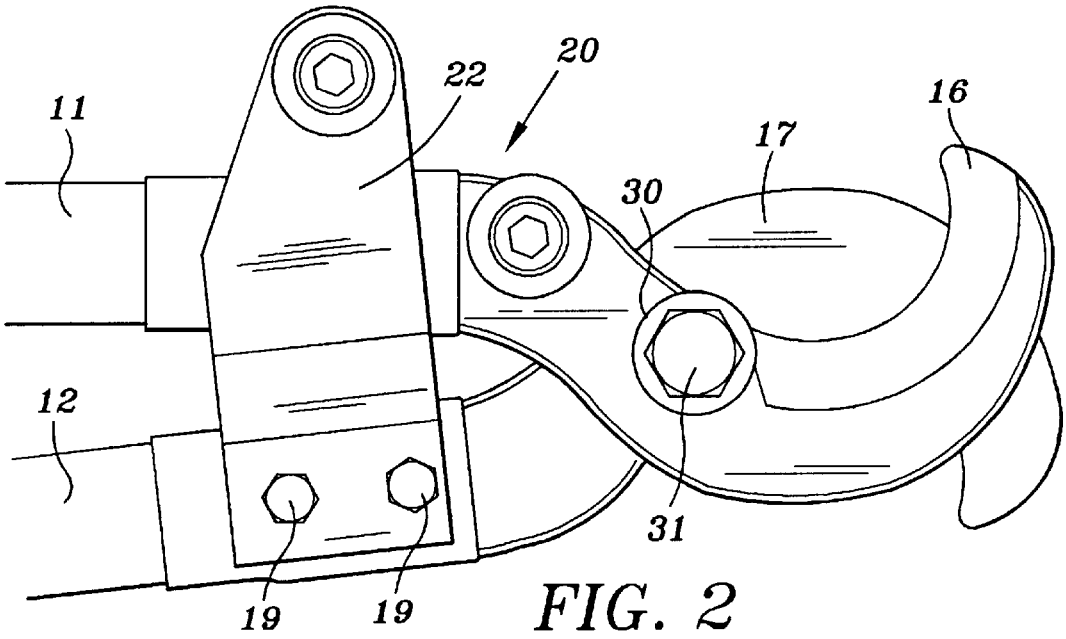
FIG. 2 is a similar view as FIG. 1 including the cable bending elements attached.
Figure 3:
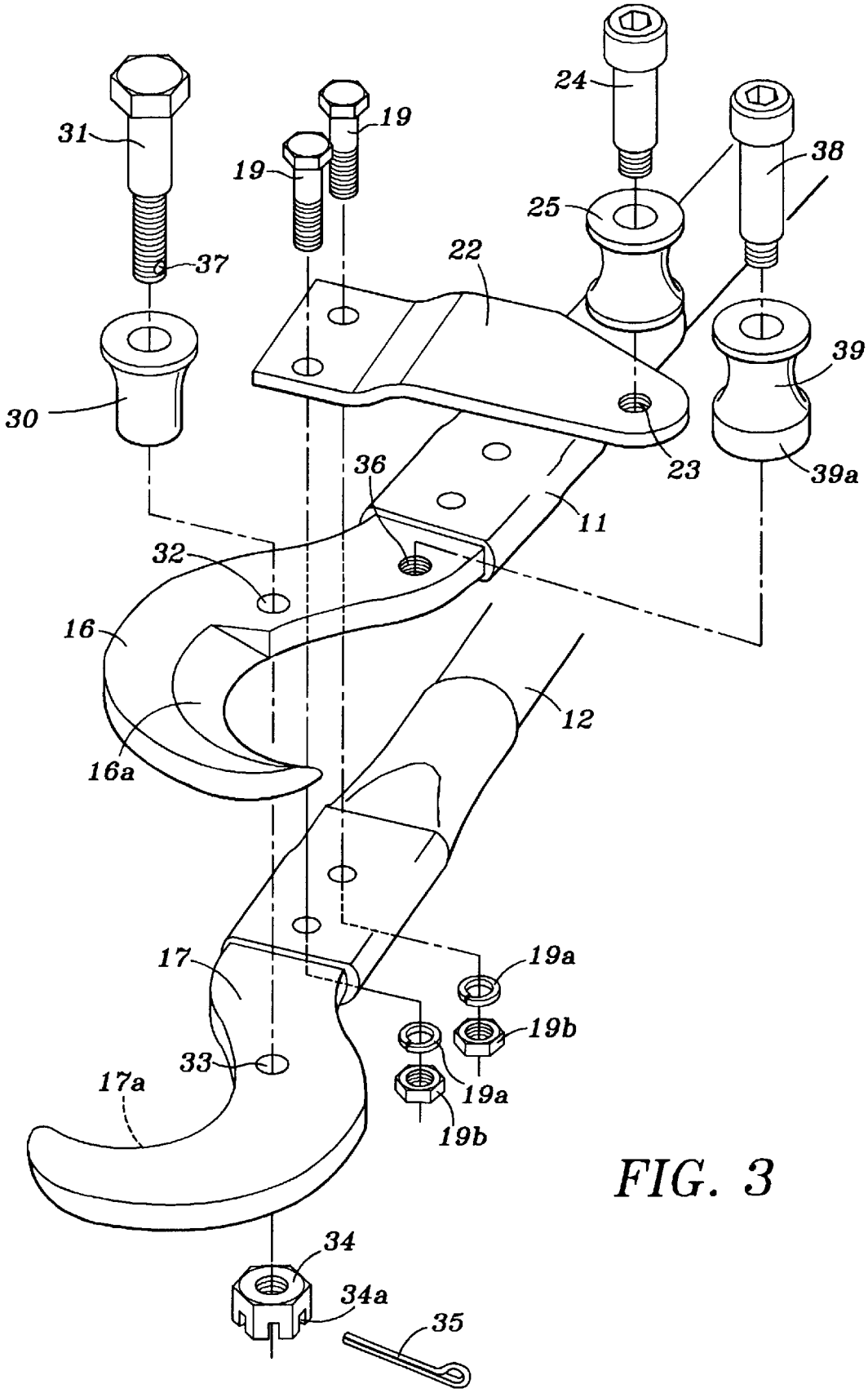
FIG. 3 is an explode view of the cable cutter and bender.

Referring now to the drawings and in particular FIGS. 1, 2, and 3, there is illustrated a cable cutter 10, having a pair of handles 11 and 12, which are pivoted around pivot pin 13 and include cutting blades 16 and 17 with cutting edge 16*a* and cutting edge 17*a*, respectively, used for cutting cable. Handle 11 is secured to cutting blade 16 by bolts 18 and handle 12 is secured to cutting blade 17 by bolts 19.

Referring particularly to FIGS. 2 and 3, cable cutter 10 is modified to provide a combination cable cutter and bender 20. Bolts 19 are removed and plate 22 is attached by bolts 19 secured by lock washers 19*a* and nuts 19*b*. Plate 22 has a tap 23 and a spindle 24 threaded into tap 23 which secures roller 25 to plate 22. Pivot pin 13 is removed and pivot roller 30 is secured by spindle bolt 31 extending through apertures 32 and 33 of cutting blades 16 and 17, respectively, with keyway nut 34 threaded onto spindle bolt 31. Spindle bolt 31 has an aperture 37 which aligns with keyway 34*a* in keyway nut 34 and is secured from loosening with cotter pin 35 extending through aperture 37. Cutting blade 16 has tap 36 and spindle 38 seated in tap 36 of cutting blade 16 retains roller 39. Rollers 25 and 39 each have centrally inward taper similar to a self-centering spool to accommodate centering cable 40 for bending. The taper length of both roller 25 and roller 39 are the same. However, roller 39 is slightly longer than 25, such that when roller 39 is secured with spindle bolt 31, the center of the taper of roller 25 and roller 39 are aligned perpendicular to a common plane. The non-pivot rollers 25 and 39 are centrally inwardly tapered in an hour glass fashion with the minimum circumference in the same plane; this is accomplished by roller 39 thicker bottom or a base 39*a*.

Figure 4:
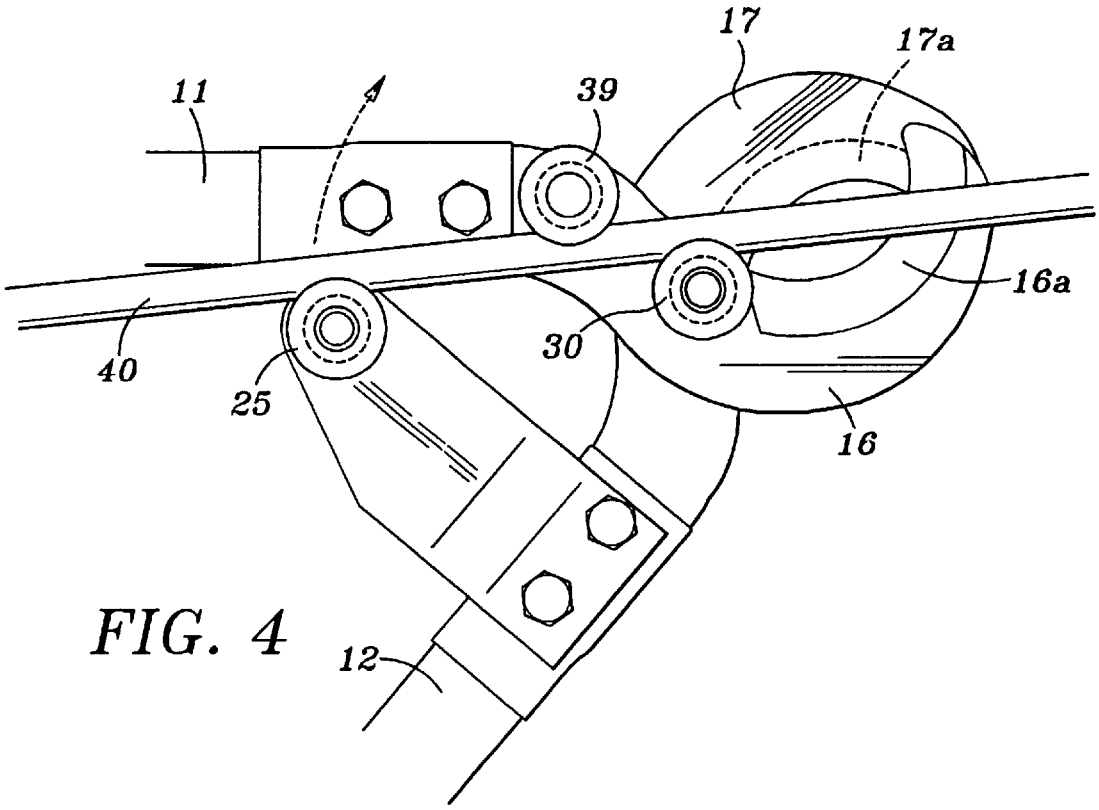
FIG. 4 is a similar view as FIG. 2, with the tool open with a cable to be bent fitted between the bending elements.
Figure 5:
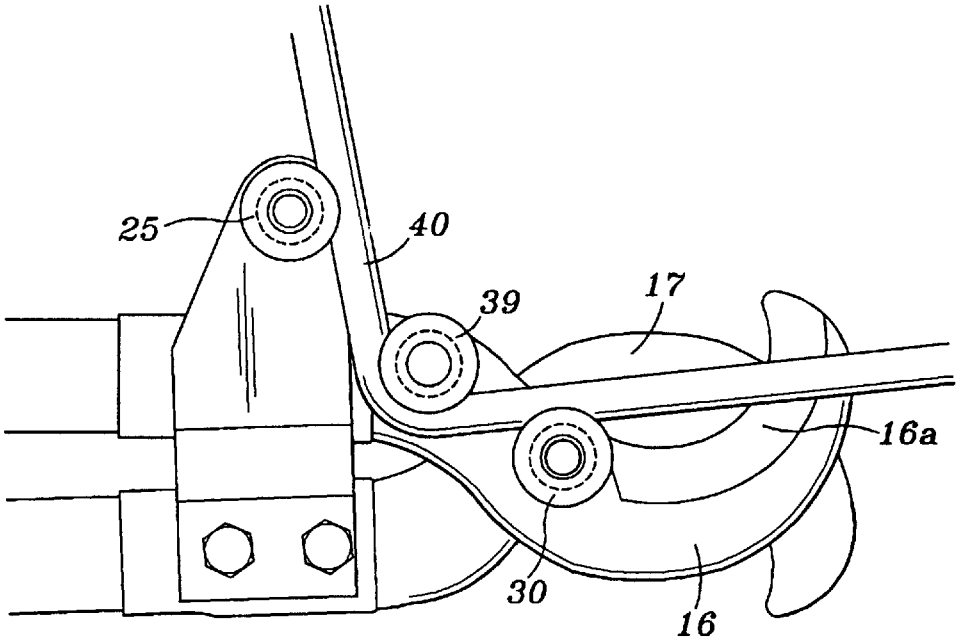
FIG. 5 is similar to FIG. 4 and shows the tool closed with an approximate ninety degree (90°) bend in the cable.

Referring now to FIGS. 4 and 5, the operation of cable bender 20 will be described. Handle 11 and handle 12 are spread apart a sufficient amount with blades 16 and 17 remaining unopened such that rollers 25, 30 and 39 engage cable 40, with cable 40 aligned in a straight line with roller 25 and roller 30 on one side of cable 40 and roller 39 on the other side of cable 40. Once the cable has been positioned in cable bender 20, handles 11 and 12 are closed towards each other, bending cable 40 to the desired angle, which maybe up to ninety (90°) degrees. The rollers 25, 30 and 39 may rotate as a result of the motion of moving along the cable in the bending process, thus lessening any chance of stripping or damaging cable 40.

It should be understood that cutting blades 16 and 17 are never completely opened in order to bend cable 40 to the extent that cable 40 can be engage unintentionally between the opening in cutting blades 16 and 17. Therefore, in bending cable 40, it is unlikely that cable 40 can be damaged by cutting edges 16*a* and 17*a* of blades 16 and 17, respectively. The combination of cable cutter and bender 20 is designed such that cable bender 20 will permit bending of cable 40, which can be any size that cable cutter and bender 20 can sever. As a result, it will be understood that at the job site location, cutting and bending of cable 40 to the desired configuration can be performed with the cable cutter and bender 20.

The particular arrangement of a tool with replaceable handles makes it simpler to attach rollers for engaging cable for bending in different configurations; however, it is contemplated that a tool with one piece handles can be modified to accomplish mounting rollers to accommodate cable bending using modified cable cutters. It should be understood that the rollers may be replaced by a fixed spool or guide which permits the cable to slide relative to the spool or guide rather than rotating the rollers.

What is claimed:

1. A combinations cable cutter and bender tool comprising:

(a) a pair of arms pivotally attached to each other by a spindle carrying a first roller, said pair of arms having opposed cutting edges at one end forming a jaw;

(b) one of said pair of arms having a second roller juxtaposed the jaw;

(c) the other of said pair of arms having a plate carrying a third roller distal from the first roller;

(d) the first, second and third rollers are so aligned that upon the pair of arms being spread apart said rollers will accommodate a straight section of a cable between the first and third rollers on one side and the second roller on the other side and upon being closed towards each other will bend the section of cable.

2. The tool of claim 1 wherein the plate is offset to overlap the one of said pair of arms.

3. The tool of claim 1 wherein the second and third rollers each have a central taper which engage the cable.

4. The tool of claim 1 wherein the pair of arms include replaceable handles.

5. A combination cable cutter and bender tool comprising:

a pair of arms each having an arcuate end with a cutting edge connected by a pivot with the arcuate ends of each arm facing each other to form a cutting jaw;

the pivot carrying a first guide;

one of said pair of arms having a second guide adjacent the pivot;

the other of said pair of arms carrying an offset plate projecting toward one arm and including a third guide;

the first, second and third guides aligned with each other upon positioning the arms spatially from each other to permit a straight segment of cable to be bent with the first and third guides on one side and the second guide on the other;

when decreasing the spatial distances between the said pair of arms the, cable may be bent to varying degrees.

6. The tool of claim 5 wherein the cutting jaw remains unopened during the bending.

7. The tool of claim 5 wherein the second guide and third guide are rollers.

8. The tool of claim 5 wherein the second guide and third guide are spools.

9. A combination cable cutter and bender tool comprising:

(a) a pair of arms, each arm of said pair terminating at one end into a cutting blade;

(b) a pivot assembly having a first tapered roller joining the pair of arms together with the cutting blade of each arm forming a cutting jaw;

(c) a second inwardly tapered roller attached to one of said pair of arms adjacent the pivot assembly;

(d) a member secured to the other of said arms carrying a third inwardly tapered roller;

(e) all of said first, second, and third rollers in the same plane such that upon moving the arms spatially apart accommodates a straight segment of a cable between the rollers for bending upon closure of the pairs of arms towards each other.

10. The tool of claim 8 wherein the each of the cutting blades describe an arc.

11. The tool of claim 8 wherein the cutting jaw remains un-open during the bending of the cable.

* * * * *